US008635897B2

(12) United States Patent
Bertram

(10) Patent No.: US 8,635,897 B2
(45) Date of Patent: Jan. 28, 2014

(54) PROFILING ARRANGEMENT FOR THE LONGITUDINAL SHAPING OF A METAL BAND OR STARTING PROFILE INTO A PROFILE OR TUBE

(75) Inventor: Frank Bertram, Bad Sackingen (DE)

(73) Assignee: Dreistern GmbH & Co. KG, Schopfheim (DE)

( * ) Notice: Subject to any disclaimer, the term of this patent is extended or adjusted under 35 U.S.C. 154(b) by 316 days.

(21) Appl. No.: 13/026,550

(22) Filed: Feb. 14, 2011

(65) Prior Publication Data

US 2011/0197644 A1 Aug. 18, 2011

(30) Foreign Application Priority Data

Feb. 12, 2010 (EP) ..... 10001461

(51) Int. Cl.
*B21D 5/08* (2006.01)

(52) U.S. Cl.
USPC ..... 72/176; 72/405.01

(58) Field of Classification Search
USPC ..... 72/51, 52, 130, 166, 168, 176, 178, 72/181, 405.01, 405.13, 422
See application file for complete search history.

(56) References Cited

U.S. PATENT DOCUMENTS

| | | | | |
|---|---|---|---|---|
| 3,357,087 | A | 12/1967 | Barnikel et al. | |
| 3,610,863 | A | 10/1971 | Doublet | |
| 4,530,225 | A | 7/1985 | Meurer et al. | |
| 4,563,802 | A * | 1/1986 | Benteler et al. | 72/422 |

FOREIGN PATENT DOCUMENTS

| | | |
|---|---|---|
| DE | 2728210 | 1/1979 |
| EP | 1375053 | 1/2004 |

* cited by examiner

*Primary Examiner* — Teresa M Ekiert
(74) *Attorney, Agent, or Firm* — Volpe and Koenig, P.C.

(57) ABSTRACT

A profiling arrangement for the longitudinal shaping of a metal band or starting profile into a profile or tube is provided, and includes a plurality of shaping stations 10 that are arranged in a line one behind the other and in each of which a group of roller shaping tools is assembled and are run through in succession by the metal band or starting profile, as well as with a machine substructure on which the shaping stations are mounted. In addition, on or next to the machine substructure, there are linear guides with driven carriages that can move in and against a direction of motion of the metal band or profile for the holding of tools, manipulators, and the like acting on the profile.

10 Claims, 2 Drawing Sheets

PROFILING ARRANGEMENT FOR THE LONGITUDINAL SHAPING OF A METAL BAND OR STARTING PROFILE INTO A PROFILE OR TUBE

CROSS-REFERENCE TO RELATED APPLCIATIONS

This application claims the benefit of European Application No. 10 001 461.2, filed Feb. 12, 2010, which is incorporated herein by reference as if fully set forth.

BACKGROUND

The invention relates to a profiling arrangement for the longitudinal shaping of a metal band or starting profile into a profile or tube using a plurality of shaping stations that are arranged one behind the other in a line and in each of which a group of roller shaping tools is assembled and that are run through in succession by the metal band or starting profile.

For a profiling arrangement of the present type, the metal band or starting profile runs through the individual shaping stations one after the other and is subjected to a shaping step at each of these stations until it has finally obtained its (temporary) final shape. The term roller shaping tool is used in the scope of the present invention as a generic term for the shaping rollers in a shaping station that could be constructed as bottom rollers, top rollers, side rollers, intermediate rollers, or as other rollers and could be used for the shaping or rolling of the work piece.

Profiling arrangements of the present type involve continuously working arrangements that produce a longitudinally shaped profile (or tube) from band material transported quasi-endlessly through the profiling arrangement. Because the profiles or tubes are generated accordingly in a length that corresponds to the length of the metal band used as the starting material, profile pieces that are finished or are ready for further processing must be cut to length, which makes a corresponding separating machine necessary. In order to produce closed profiles or tubes, the profiling arrangement typically also comprises, in addition to the actual profiling machine formed from the shaping stations, a welding device in which the continuously running profile is welded longitudinally.

Furthermore, stamping machines or similar non-continuous processing machines, such as, for example, embossing and bending machines, are often integrated into the profiling arrangements. If these are to be arranged before the separating device, in order to form, for example, stamps in an already partially shaped profile before it is further shaped longitudinally in additional shaping stations, then the profiling arrangement must brake the transport of the profile up to a standstill at intervals, prior to then starting up again. During the standstill of the profile, the stamping operation and the like can then be performed. A braking of the profile transport by a band loop can be avoided only when a flat metal band with stamps is to be provided before the first shaping step. This measure stops as soon as a first, longitudinal bend has been formed in the metal band.

It is obvious that an interval-like stopping and restarting of the profile transport decreases the average production speed of a profiling arrangement. In addition, this produces special requirements on parts of the arrangement that are dependent on a continuous transport of the profile, such as, in particular, for a welding device. In one patent application of the applicant (EP-A-1 375 053), this problem was indeed solved, so that even for interval-like stopping of the profile transport, a continuous, uniform weld seam could be produced; however, the expense here is naturally higher than for a simple welding device that generates a longitudinal weld seam on a profile transported continuously through the welding device.

SUMMARY

The present invention is therefore based on the objective of providing a profiling arrangement in which processing steps with discontinuously operating devices can be integrated with lower expense than before.

This objective is met by a profiling arrangement according to the invention. Advantageous refinements of the profiling arrangement according to the invention are described below and in the claims.

A profiling arrangement equipped according to the invention with at least a plurality of shaping stations mounted on a machine substructure consequently provides on or next to the machine substructure linear guides, with driven carriages that can move in and against the direction of motion of the metal band or profile sitting on these guides. These carriages are used for holding tools acting on the profile, for example, for separating, stamping, embossing, and the like, as well as manipulators, welding devices, or other devices that process the profile. The moveable carriages can be arranged before or between the shaping stations, as well as before or after the separating device, wherein the separating device itself can likewise be mounted on such a carriage. Processing steps after the separating device that are performed with tools on a carriage according to the invention could be, for example, the setting of miter cuts or the formation of stamps or the like in the finished profile.

The linear guides advantageously run essentially along the entire machine substructure, wherein, however, this is not necessary in the scope of the present invention. It could be provided, for example, to provide linear guides according to the invention with moveable carriages only in the region of the separating device. Likewise, it is possible, for example, to provide a moveable carriage with, for example, one intermediate stamping machine only between two functional groups each with several shaping stations.

In the scope of the present invention it is also not necessary that the linear guides and the carriages are mounted directly on the machine substructure; instead it is also possible to mount linear guides laterally next to the machine substructure, wherein, however, the carriages mounted on these guides then usually must be moved over the machine substructure, in order to be able to carry tools or manipulators that act on the profile. This allows, in particular, the retrofitting of already existing profiling arrangements with carriages according to the invention.

Most advantageously, however, the invention is realized such that a continuous machine substructure is present with continuous linear guides, so that the profiling arrangement can be built in a modular way on the machine substructure. For this purpose, in addition to the linear guides on the machine substructure, holding devices can be provided that are used for the mounting of functional groups with several shaping stations or directly for the shaping stations.

In this case it is then useful if there are several carriages that can move independently of each other. Obviously this does not rule out that two or more carriages are coupled with each other using control technology or mechanically.

For the drive of the individual carriages, it can be provided that toothed racks are mounted along the linear guides on or next to the machine substructure. The carriages can then run along these toothed racks with reference to the driven toothed wheels.

Alternatively, however, the drive of the carriages could also be performed by linear motors or in some other way. If the carriages are driven with linear motors, preferably the primary part of the linear motor is located on the carriage and the secondary part is located on the linear guides along which the carriage runs.

Preferably, each carriage is provided with a drag chain for supply lines, such as power lines, pneumatic lines, and the like, so that it can move autonomously along the linear guides or on the machine substructure.

The profiling arrangement according to the invention does not have to be built completely in a modular way, in order to produce special advantages relative to the prior art. It is sufficient, for example, to provide, after a co-running cutting unit, at least one carriage that can move together with the cutting unit and with a manipulator that is equipped with gripping tools. This grips the profile or tube to be cut before or during the separating cut, so that the cut profile or tube remains in a defined position and orientation after the separating cut. The manipulator can then transfer the cut profile or tube in a defined way to a device for transporting it away or for further processing of the cut profiles or tubes, wherein advantageously it sits on a carriage that can be accelerated to a speed lying above the normal profile speed; in this way it can perform an accelerated transport movement after the separating cut and can separate the cut profile or tube for better transfer from the following profile billet.

This realization of the inventive concept overcomes the previous disadvantage of all of the profiling arrangements according to the prior art in which the profile or tube cut by a co-running cutting machine falls onto a transport device, a magazine, or into a tub, so that, in particular, the orientation, that is, the angular position of the profile or tube about its longitudinal axis is random. The orientation especially of profiles, however, is then not only important when they are packaged for shipping. A transfer of profiles defined especially in their orientation had to be performed up to now by hand accordingly. An automated gripping of the profiles possible with the present invention is still possible during the cutting process, so that the profiles have a defined, known position and orientation when they are gripped. A transfer defined in position and orientation is then still only a question of known control technology.

A manipulator running on a carriage according to the invention for the transfer of cut profiles, or advantageously two such carriages with manipulators is, as already mentioned, advantageously in the position to accelerate the profile movement after the cutting of the profile, in order to separate the cut profile from the following profile billet before it is transferred. The transfer itself can then be performed advantageously to the right and to the left relative to the direction of movement and this preferably in different positions relative to the profile movement. In this way, for example, profiles of different length could be transferred sorted or, for example, low-quality profiles could be ejected.

In the scope of the present invention, several cutting units could also be provided that advantageously cooperate with one or more associated manipulators. This can significantly increase the productivity of the entire arrangement especially when only short pieces of a basically endless profile are to be cut to length. This is because, for example, with two cutting units, two profile pieces could be cut from the profile billet simultaneously for each processing step, while the production continues at a non-reduced speed. The advantageously present manipulators ensure that, in particular, the cut profile pieces located between two cutting units are removed in order from the movement region of the cutting units.

BRIEF DESCRIPTION OF THE DRAWINGS

One embodiment for a profiling arrangement constructed according to the invention is described and explained in detail below with reference to the accompanying figures of the drawing. Shown are.

DETAILED DESCRIPTION OF THE PREFERRED EMBODIMENTS

Figure 1:
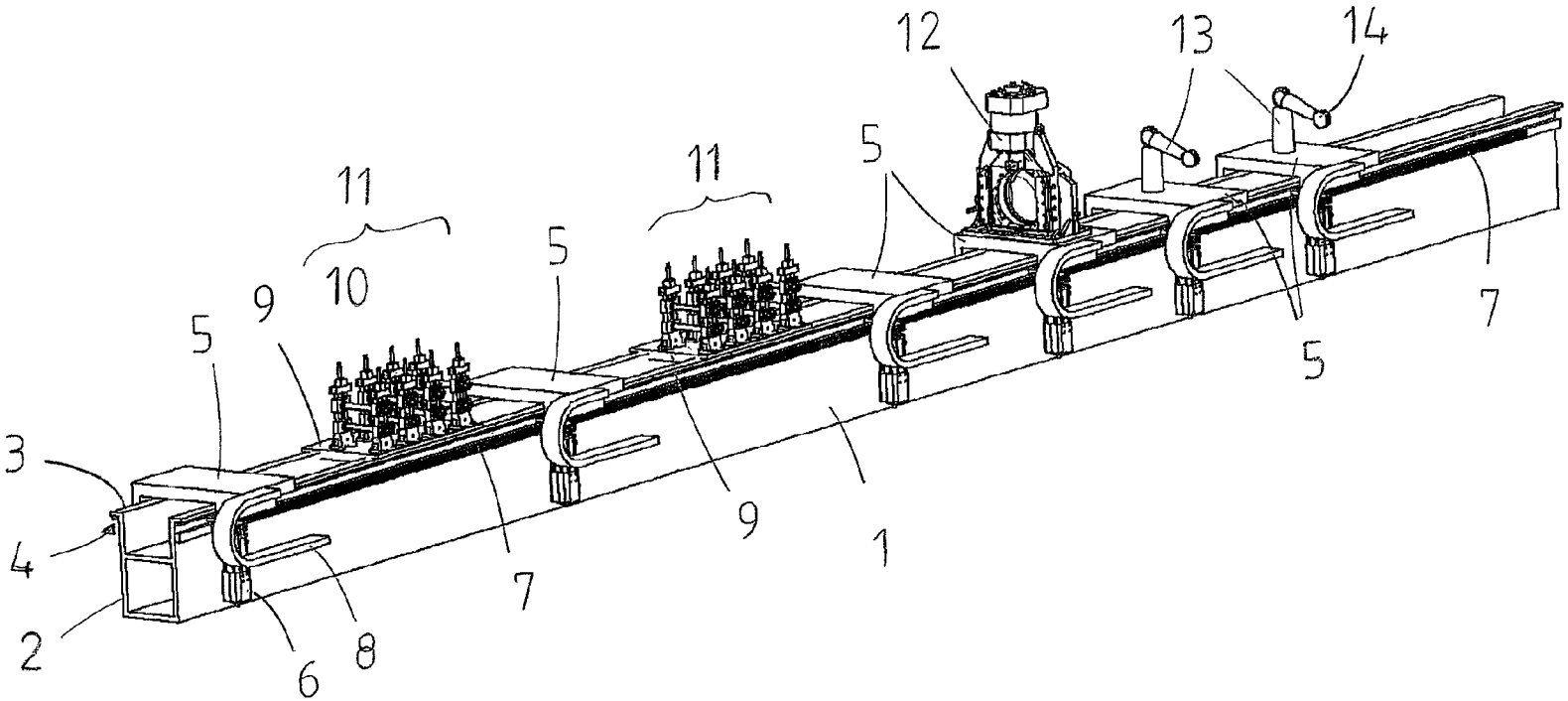
FIG. 1 is a perspective, schematic view of a profiling arrangement constructed according to the invention.

In FIG. 1, an embodiment for a profiling arrangement constructed according to the invention is shown schematically in a perspective view. This profiling arrangement is built in a completely modular way, wherein, in particular, a continuous machine substructure 1 is present. This consists essentially from a metal profile 2 with a U-shaped basic form with lateral projections 3. The lateral projections 3 form linear guides 4 for carriages 5 that can move along these linear guides 4. Each of these carriages 5 has available a separate drive device 6 that includes, in the present case, an electric motor that drives a toothed wheel. Across the entire length of the machine substructure 1, a toothed rack 7 is arranged parallel to the linear guides 4 in which the toothed wheels of the drive devices 6 of the moveable carriages 5 engage. The positions of the carriages 5 are consequently fixed exactly and are to be started up at any time exactly, for example, by use of a stationary transducer on the machine substructure 1 as an absolute path measurement system or by use of transducers on the individual electric motors as a relative path measurement system with zero-point definition and an increment counter. Each carriage 5 also has available a drag chain 8 for (not shown) supply lines, here, in particular, power lines for the drive device 6 and a signal line for the required control of the carriage 5.

Apart from the linear guides 4, the machine substructure 1 has available (not shown in detail) holding devices and centering pins for quick-change plates 9 on which the actual profiling machine is built: each quick-change plate 9 carries, in the present case, four racks 10 for the storage of (not shown) roller shaping tools, so that each rack 10 forms a shaping station for the longitudinal shaping of a metal band or profile. This metal band or profile is not shown in FIG. 1; it is guided above the machine substructure 1, parallel to this substructure, through the shaping stations 10 and shaped in these stations step by step.

Consequently, in the present embodiment, two functional groups 11 with several shaping stations 10 are each set on a quick-change plate 9 on the machine substructure 1, and indeed spaced apart from each other. Between the two functional groups 11, as well as in front of and after the groups, there is an autonomously moving carriage 5 on which processing machines, such as, in particular, machines for pre-stamping and intermediate stamping can be mounted. These processing machines run simultaneously during the processing step with the profile transported continuously through the functional groups 11 and thus can perform the processing at a "zero" relative speed.

The construction shown in FIG. 1 is merely an example; the number and sequence of carriages 5 and the shaping station functional groups 11 is completely free. With the concept according to the invention, at each point of the profiling arrangement, functions such as stamping, embossing, bending, welding, as well as the actual profiling and the cutting can be arranged. This modular construction makes it possible to realize arbitrary production strategies on an arrangement. Discontinuous processing steps, such as, in particular, stamping, can be performed at the same time, wherein the partial performance of the profiling arrangement is increased. In addition, discontinuous processing steps, such as stamping processes, can be combined with other methods that require a continuous process, such as for example, welding, forming, shaping, and the like.

The profiling arrangement shown in FIG. 1 is finally provided with a cutting unit 12 for the cutting of the completely shaped profiles, with this cutting unit being mounted, on its part, on a moving carriage 5 and operating in co-running operation. Connected after the cutting unit 12, two additional carriages 5 each with a manipulator 13 can be seen. This section of the present embodiment of a profiling arrangement constructed according to the invention is shown more clearly in FIG. 2.

Figure 2:
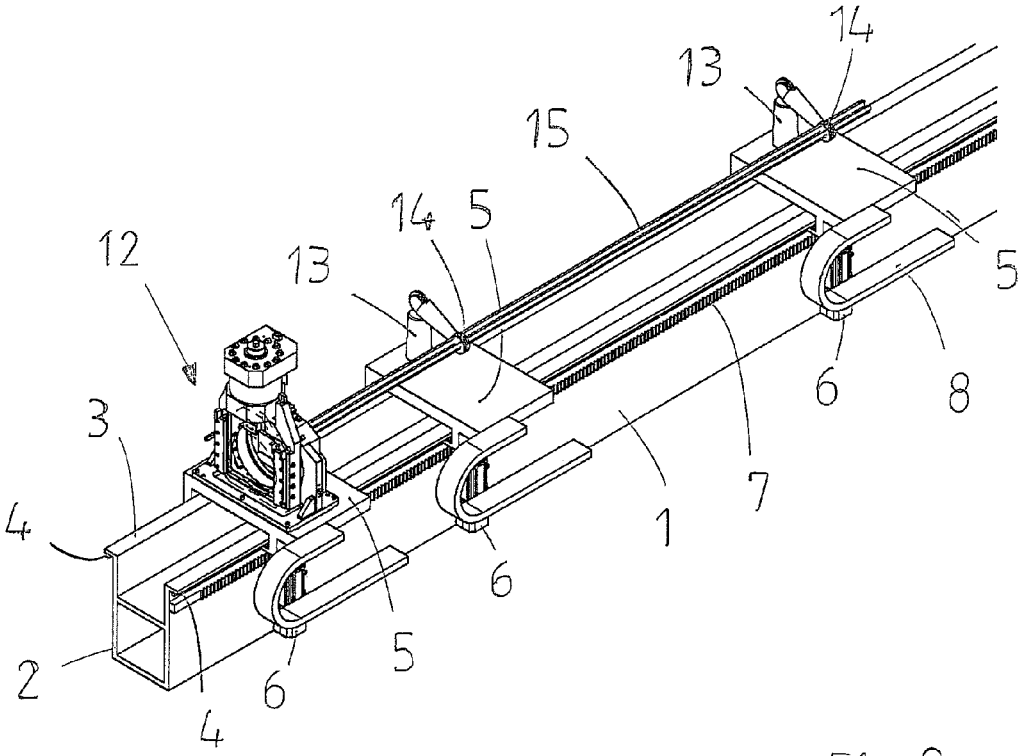
FIG. 2 is a schematic, perspective view of the rear part of this profiling arrangement.

The end section shown in FIG. 2 of the profiling arrangement from FIG. 1 comprises the cutting unit 12 as well as the two manipulators 13 that are all mounted each on an autonomously moveable carriage 5. The two manipulators 13 each activate a gripper 14 for gripping a profile 15 before or during the cutting in the cutting unit 12. For this purpose, the two carriages of the manipulators 13 run in sync with the carriage 5 of the cutting unit 12 with the profile 15. They are spaced apart from each other such that the profile 15 can be gripped and held at the most optimal points with respect to its own stability by the grippers 14. If shorter profiles 15 are cut, then the spacing of the two carriages is reduced.

As soon as the cutting unit 12 has cut the profile 15, the carriages 5 of the two manipulators 13 accelerate, in order to separate the profile 15 from the cutting unit 12 and from the profile billet following this profile. When this has been performed, the manipulators 13 can pivot the grippers 14 in the counterclockwise direction, so that the profile 15 is discharged to the left relative to the direction of movement. In this way, because the grippers 14 have already gripped the profile 15 during the cutting process, the discharge of the profile 15 can be performed with a known, defined position and orientation of this profile.

Before the discharge of the profile 15 is performed by the manipulators 13, on (not shown) other carriages, other processing devices, for example, a device for forming a miter cut in the profile 15, could be activated and a miter cut could already be performed during the co-running. For simplifying the control technology, the carriages 5 shown in FIG. 2 can run optionally also mechanically coupled. In this way, only the flexibility with respect to different lengths of the profiles 15 would be limited.

The end section shown in FIG. 2 of a profiling arrangement could also be built on a conventional profiling arrangement that is otherwise not constructed according to the invention and this conventional profiling arrangement could be retrofitted accordingly in accordance with the invention.

The invention claimed is:

1. Profiling arrangement for longitudinal shaping of a metal band or starting profile into a profile or tube, comprising:

a plurality of shaping stations (10) that are arranged one behind the other in a line and in each of which a group (11) of roller shaping tools is assembled and are run through in succession by the metal band or starting profile;

a machine substructure (1) on which the shaping stations (10) are mounted, directly or indirectly;

linear guides (4) with at least one driven carriage (5) that can move in and opposite a direction of motion of the metal band or profile for holding at least one of tools (12) or manipulators (13) that are adapted to act on the profile (15), the linear guides (4) are provided on or the machine substructure (1);

the profiling arrangement has an at least partially modular construction with the machine substructure (1) on which the linear guides (4) are mounted for the at least one driven carriage (5), and the at least one driven carriage is moveable along the machine substructure (1) with the at least one of tools (12) or manipulators (13) connected thereto that are adapted to act on the profile (15) while being supported or mounted on the at least one driven carriage.

2. Profiling arrangement according to claim 1, wherein toothed racks (7) are provided along the linear guides (4).

3. Profiling arrangement according to claim 1, wherein a drive for the at least one driven carriage (5) comprises a linear motor, a primary part of the motor is arranged on the at least one carriage (5) and a secondary part of the motor is arranged along the linear guides (4).

4. Profiling arrangement according to claim 1, wherein the at least one driven carriage comprises a plurality of driven carriages (5) that can move independent of each other.

5. Profiling arrangement according to claim 4, wherein the plurality of driven carriages (5) are each provided with a drag chain (8) for supply lines.

6. Profiling arrangement according to claim 1, wherein stamping, embossing, or bending tools are mounted on the plurality of driven carriages (5) that are arranged between two or more shaping station functional groups (11).

7. Profiling arrangement according to claim 6, wherein at least one co-running cutting unit (12) is provided, connected downstream of the plurality of shaping stations (10), and at least one of the plurality of driven carriages (5) is located after the cutting unit (12) that is moveable in sync with the cutting unit (12) with the manipulator (13) with gripping tools (14) adapted to grip a cut profile (15) or tube before or during a separating cut and to transfer the cut profile after the separating cut in a defined position and orientation to a device for transporting the cut profile away or for further processing of the cut profile.

8. Profiling arrangement according to claim 7, wherein the at least one co-running cutting unit comprises a plurality of cutting units (12), and the cutting units (12) and the manipulators (13) are moveable separately or coupled electrically and/or mechanically.

9. Profiling arrangement according to claim 7, wherein the at least one carriage (5) can be driven faster than a speed of the profile (15), in order to be able to perform, after the separating cut, an accelerated transport movement for a longitudinal separation of the cut profile (15) or tube.

10. Profiling arrangement according to claim 7, wherein the manipulator (13) is constructed so that it can transfer the cut profile (15) or tube, viewed in a direction of motion, selectively to the right and to the left and/or in different positions.

* * * * *